United States Patent [19]

Bowen et al.

[11] 4,446,986

[45] May 8, 1984

[54] FLUID TIGHT CONTAINER AND CLOSURE ASSEMBLY

[75] Inventors: Gary D. Bowen, Glens Falls; James L. Bowen, Fort Ann, both of N.Y.

[73] Assignee: Genpak Corporation, Glens Falls, N.Y.

[21] Appl. No.: 404,147

[22] Filed: Aug. 2, 1982

[51] Int. Cl.[3] ..... B65D 39/00

[52] U.S. Cl. ..... 220/307; 220/91; 220/90; 220/284

[58] Field of Search ..... 220/307, 90, 91, 284; 150/0.5

[56] References Cited

U.S. PATENT DOCUMENTS

| | | | |
|---|---|---|---|
| 4,210,258 | 7/1980 | Von Holdt | 220/307 |
| 4,349,119 | 9/1982 | Letica | 220/307 |
| 4,351,448 | 9/1982 | Ingersoll et al. | 220/91 |

*Primary Examiner*—George T. Hall

*Attorney, Agent, or Firm*—Stevens, Davis, Miller & Mosher

[57] ABSTRACT

A plastic fluid tight container and closure assembly comprising a plastic container having a base, a sidewall extending upwardly from the base terminating in a rim defining an opening for the container, said sidewall defining on its inside a sloping abutment surface extending inwardly and downwardly from said rim and an annular notch terminating said abutment surface, and a plastic closure having a circular cover portion, a U-shaped annular rim joined to the periphery of said cover portion, said U-shaped rim having an inner wall and a radially spaced outer wall connected by a base to said inner wall, the outside of said outer wall defining an annular shoulder positioned above the level of the base, an abutment surface extending upwardly and outwardly from the shoulder and an angular annular flange joined to the upper end of the outer wall to form an annular groove, said closure when assembled on said container having its shoulder locked to the notch of said container, its abutment surface in liquid sealing contact with the abutment surface of said container and its annular groove fitting over the rim of said container.

16 Claims, 9 Drawing Figures

FIG. 2
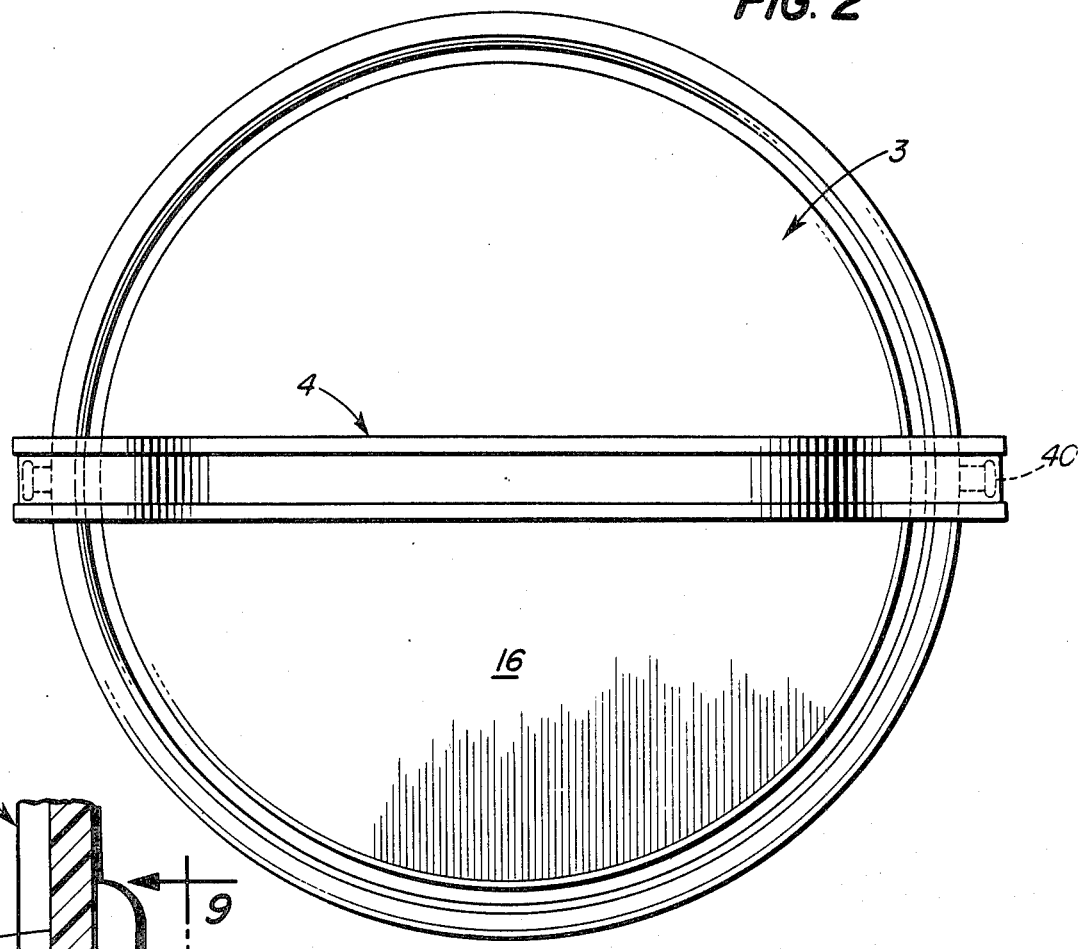
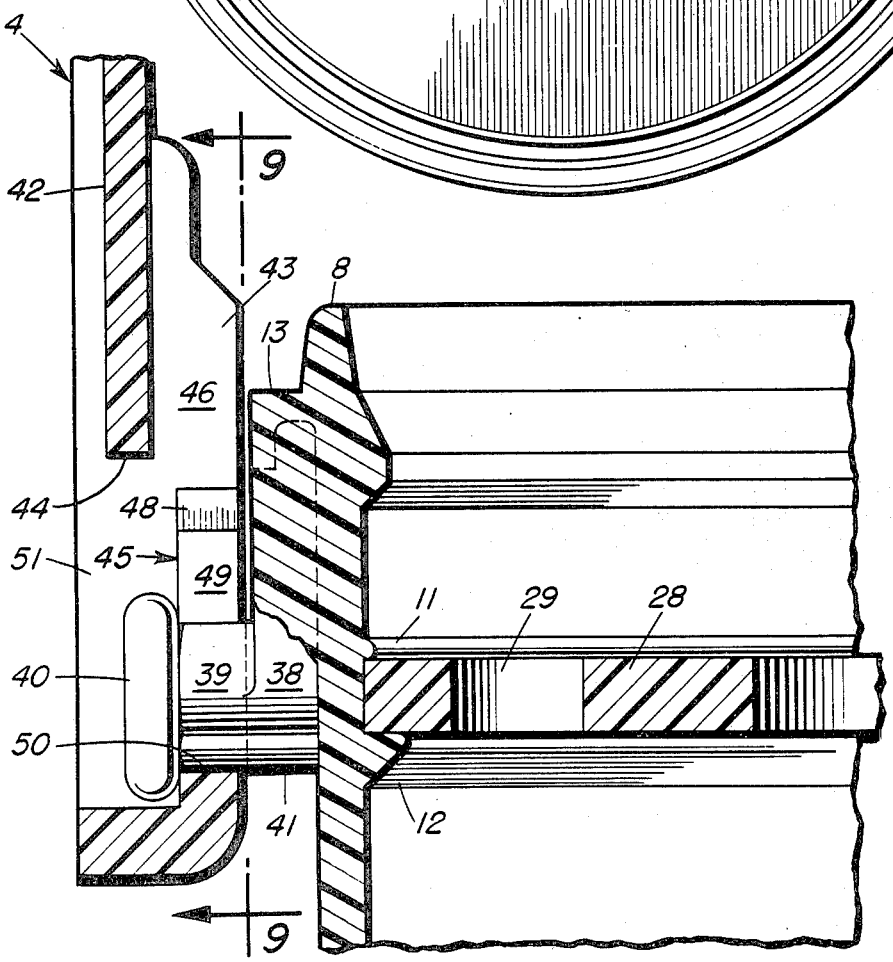
FIG. 8

FLUID TIGHT CONTAINER AND CLOSURE ASSEMBLY

BACKGROUND OF THE INVENTION

This invention relates to a plastic fluid tight container attachable with handle and closure in which a fluid tight seal is provided between the outer wall of the closure and the inner wall of the container. More particularly, the invention relates to a fluid tight paint container with attachable handle and closure made from polypropylene or polyethylene in which the closure has a U-shaped rim which fits inside the container wall. The container may carry an inwardly extending annular washer against which a brush, carrying excess paint, may be wiped.

One of the main disadvantages of known paint containers aside from being made from metal and therefore susceptible of rusting and expensive to produce is the lock between the container and closure which utilizes a groove on the inside of the container. The groove fills with paint in pouring the paint from one container to another or through normal use in removing the paint from the container by brush from which excess paint has been removed.

Another disadvantage of known metal paint containers is the difficulty in opening or reopening the container. The bead which surrounds the closure and against which the lever is applied in prying the closure off becomes easily damaged thus preventing easy access and reaccess to the container.

Another disadvantage of known metal paint containers is that known metal containers and closures filled with paint are very susceptible to opening when dropped from a very low height. Known metal paint containers when filled will open when dropped on their sides from a height as small as one inch.

Still another disadvantage of known metal paint container is the ease with which the labelled information on the outside thereof is removed.

Metal paint containers are normally marked with information such as instructions for use, color, manufacturer, content etc. by a paper wrapper. Once the labelled wrapper pasted around the container's exterior has become wetted or torn it is removed easily thereby making the content of the container a mystery. This disadvantage can be alleviated by printing the information on the container. Also from a cosmetic viewpoint it is often desirable to decorate the container's exterior. In the case of plastic containers a high gloss is desirable as a base for such printing or decorating.

Another disadvantage of known paint containers is the handle which is readily pivotable from one side of the container to the other but will not maintain an upright position if desired.

It is therefore an object of this invention to provide a fluid tight plastic container and closure which does not have an annular groove on the interior of the container at its top.

Another object of this invention is to provide a fluid tight plastic paint container and closure which when filled will withstand opening when dropped from heights several times the opening heights of filled metal paint containers and closures.

A further object of this invention is to provide a fluid tight plastic container and closure having a high gloss to permit printing and decorating thereon and avoid the need for printed labels.

A still further object of this invention is to provide a fluid tight container and closure with an attachable handle which will remain in the position in which it is placed.

SUMMARY OF THE INVENTION

According to the present invention, there is provided a plastic closure and plastic container the closure having a U-shaped annular rim and a cover portion lying within the rim and joined to the inner wall of the rim at the top thereof, the outer wall of the rim having on its outside a shoulder above the base of the "U" and an upwardly and outwardly extending abutment surface above the shoulder terminating at its tip in an angular radial flange.

The container has a circular base, a side wall extending upwardly from the base and a rim defining an opening for the container. The inside wall of the container has a sloping abutment surface extending inwardly and downwardly from the container rim to terminate in an annular notch and two annular parallel beads below the notch. The outside wall has an annular flange with a skirt positioned above the level of the notch but vertically spaced from the angular flange of the closure when the closure and container are assembled. The two annular parallel beads support a washer which acts as a paint brush wipe and gives structural integrity to the upper portion of the container.

Two diametrically opposed radially directed cylindrical anchoring studs are integrally formed with a base vertically connected to the annular flange on the outside of the wall of the container. Integral with and parallel to the axis of the studs are two spaced beads on the lower portion of each stud. At the end of each stud and integral therewith is a cylindrical disk of diameter larger than the diameter of the stud. Attached to the studs is a plastic handle having at each end an elongated slot to guide the disk into a section of said slot of a width slightly less than the diameter of the stud and an end section of said slot which is substantially the diameter of the stud.

BRIEF DESCRIPTION OF THE DRAWING

Other details and features of the invention will stand out from the description given below by way of non-limitative example and with reference to the accompanying drawings, in which:

FIG. 2 is a plan view of the container and closure of FIG. 1;

FIG. 8 is an enlarged elevational sectional view of the handle assembly;

DESCRIPTION OF THE PREFERRED EMBODIMENTS

Similar or the same parts are indicated by the same reference number.

Figure 1:
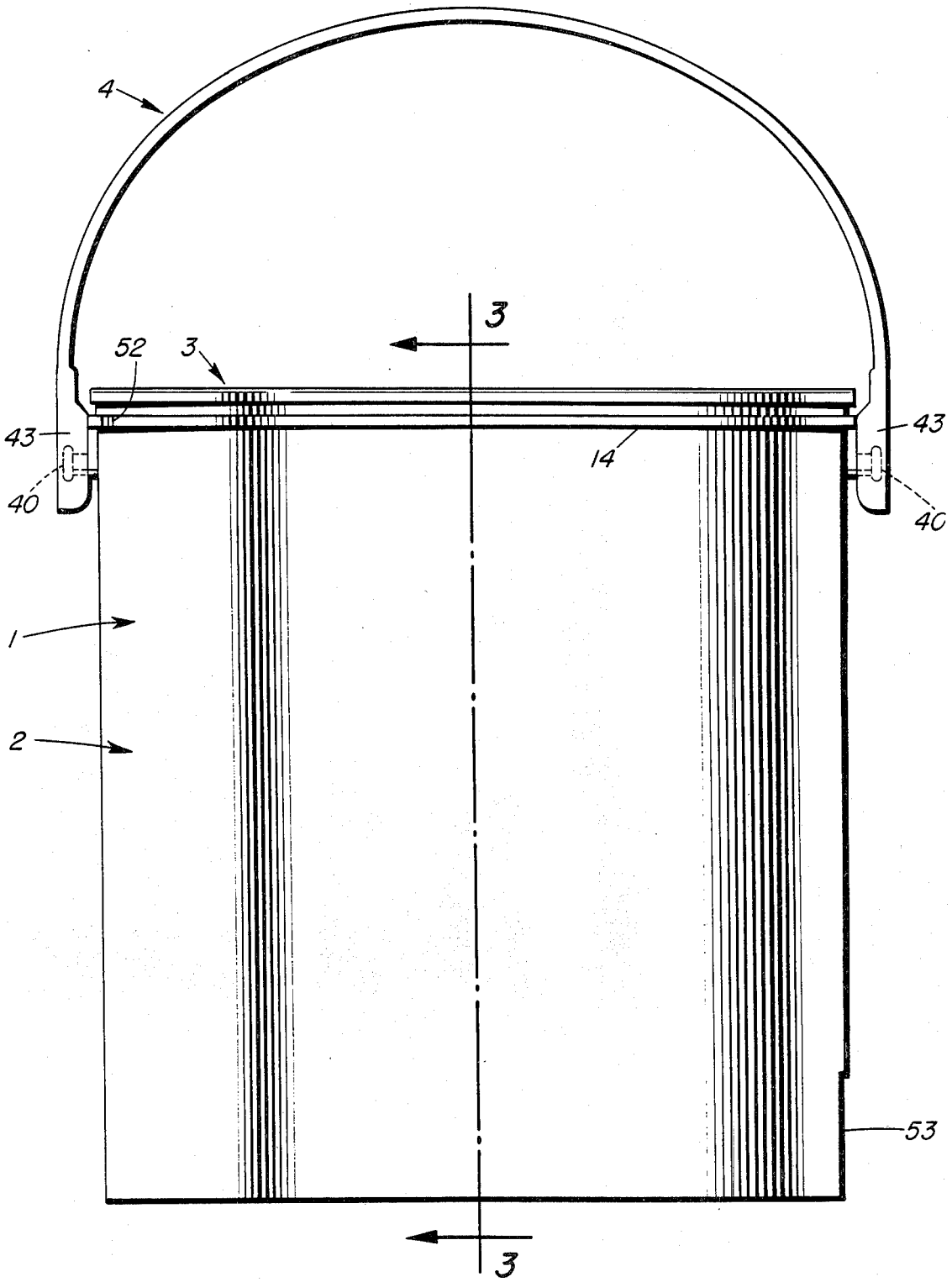
FIG. 1 is an elevational view of the container and closure of the invention.
Figure 3:
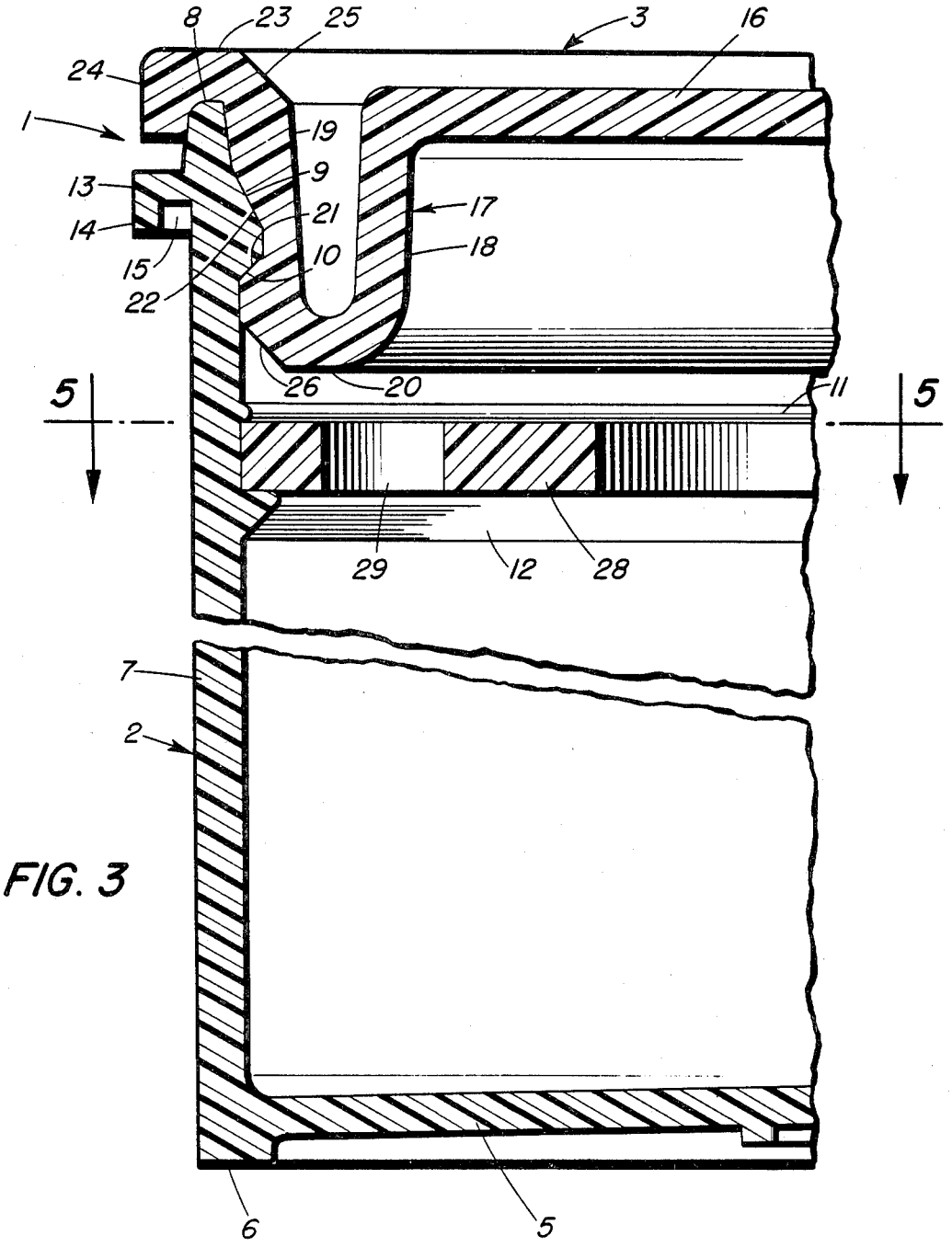
FIG. 3 is an elevational sectional view taken along line 3—3 of FIG. 1.

In FIGS. 1 and 2 the assembly 1 is composed of a container 2, a closure 3 and a handle 4 all of which are made of plastic material, preferably polypropylene but may also be made of polyethylene. More clearly shown in FIG. 3, the container 2 has a base 5 having an annular flange 6, a sidewall 7 extending upwardly to a rim 8 which forms the opening for the container 2. The inside of the wall 7 near the rim 8 defines a downwardly and inwardly extending abutment surface 9 which terminates at an annular notch 10. Below the notch 10 are two annular beads 11 and 12 whose utility will be described later. The outside of the wall 7 defines an annular flange 13 from which depends an annular skirt 14. Between the skirt 14 and wall 7 are uniformly spaced radial extending braces 15. The bottom of skirt 14 is positioned above the level of notch 10.

The closure 3 has a circular cover portion 16 connected at its periphery to a U-shaped annular rim 17 defining an inner wall 18 and a radially spaced outer wall 19 connected by a base 20 to wall 18. Inner wall 18 is connected to cover 16 at its upper end. The outside of outer wall 19 defines an annular shoulder 21 positioned above the level of the base 20. Extending upwardly and outwardly from the shoulder 21 is an abutment surface 22 which terminates at an angular annular flange 23 attached to the upper end of the outer wall 19. The angular annular flange 23 forms a groove 24 with the outer wall 19 which is complementary to rim 8 of the container 2. The outer wall 19 has an internal bevel 25 and an external bevel 26 utilized when the closures are stacked.

In assembling the container 2 and closure 3 the U-shaped rim 17 of the closure 3 fits within the inner side of wall 7 of container 2 whereby shoulder 21 snaps into place over notch 10 and locks therewith. Abutment surfaces 9 and 22 at the same time are in sealing contact with each other and groove 24 fits over rim 8. A fluid tight seal is obtained which will not release when the assembly filled with liquid is dropped from a height several times that height from which liquid filled metal containers when dropped will open.

Figure 4:
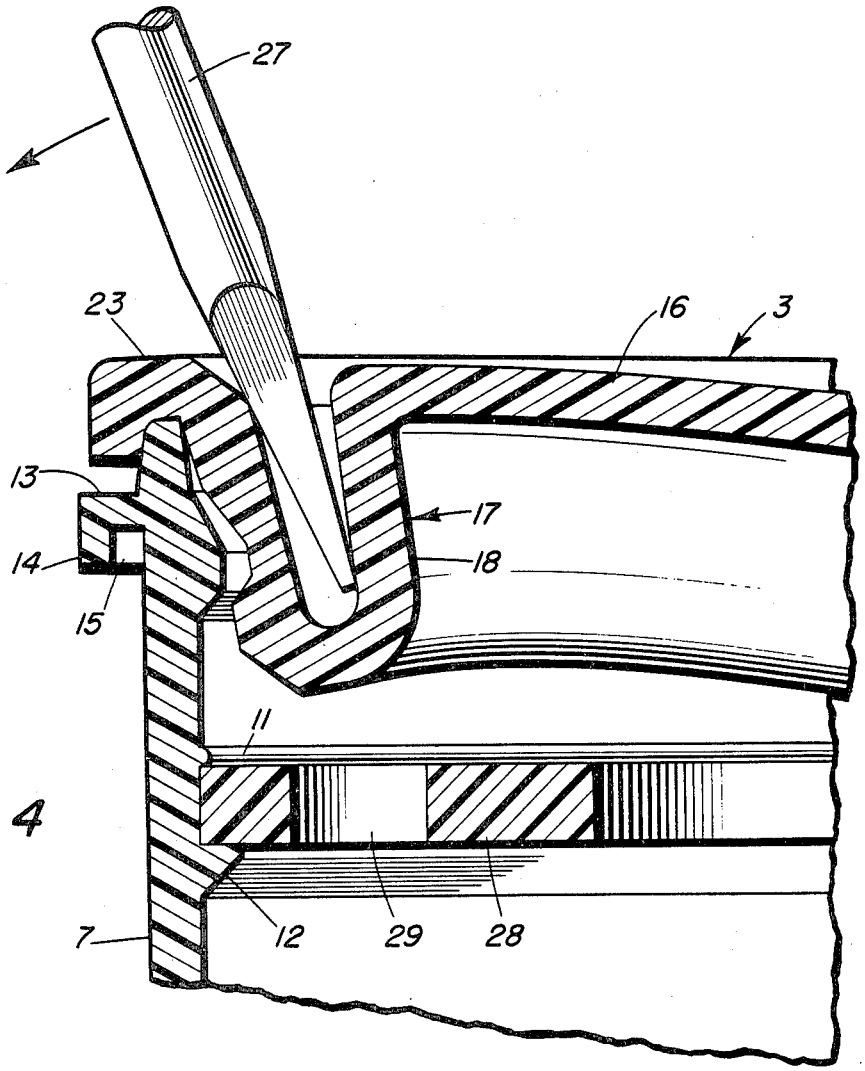
FIG. 4 is an enlarged sectional view indicating the manner for removing the closure.

To open such an assembly it is necessary to insert a tool such as a screwdriver 27 into the groove defined by the inner wall 18 and outer wall 19 of the closure 3 and leverage outwardly as in FIG. 4. The flexibility of the material of the assembly permits the closure 3 to flex at substantially one quarter of the way around the closure to pop the closure free. With a tool properly used the closure 3 is thus easily disengaged from the container 2. The closure 3 can not be disengaged from the container 2 by prying with a tool between the annular flange 23 of the closure 3 and flange 13 of container 2. To attempt to do so will only destroy both flanges.

Figure 5:
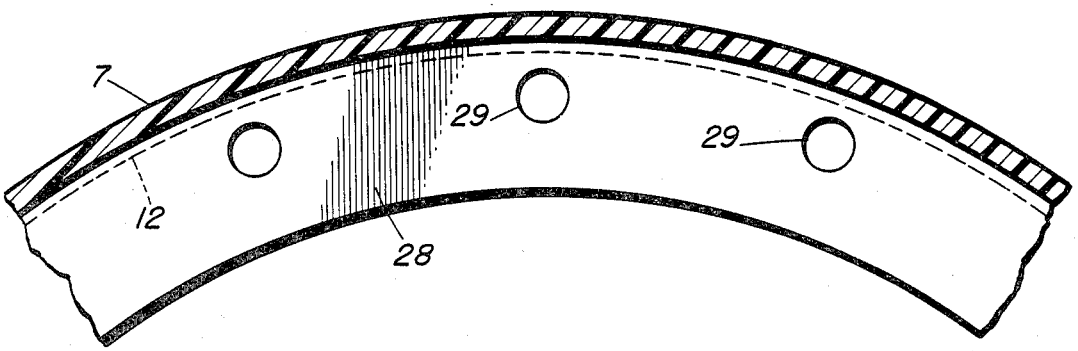
FIG. 5 is a partial plan sectional view of one embodiment of a wiper ring of the invention taken along line 5—5 of FIG. 3.
Figure 6:
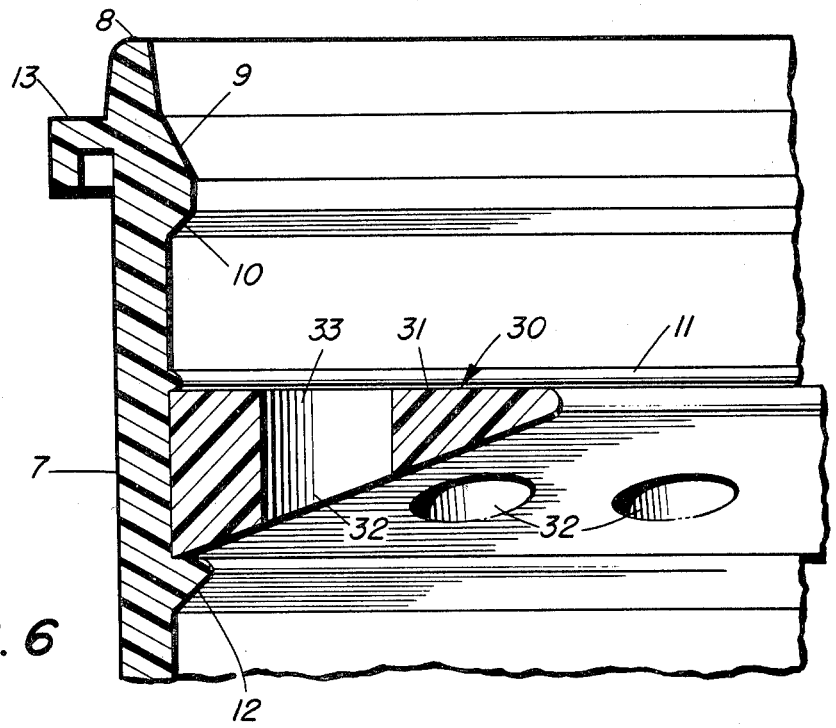
FIG. 6 is a partial elevational sectional view of a second embodiment of a wiper ring in place.
Figure 7:
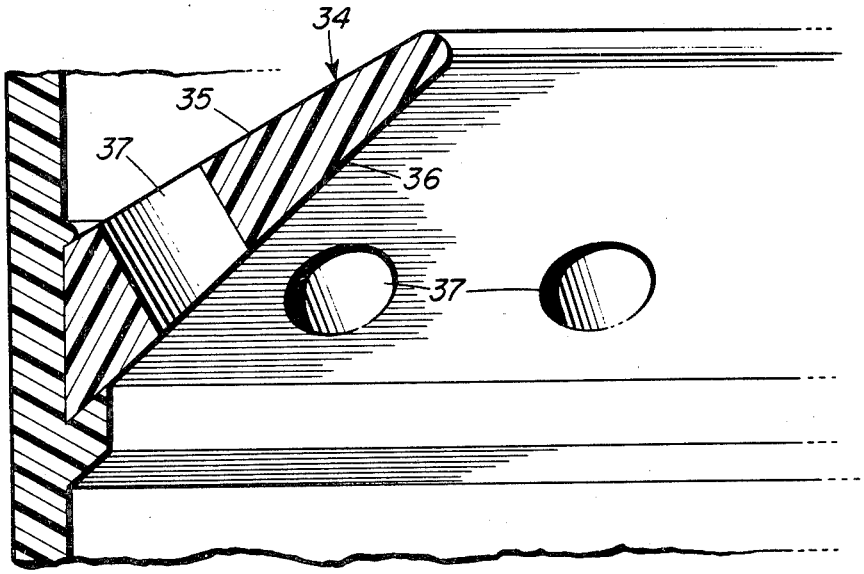
FIG. 7 is a partial elevational sectional view of a third embodiment of a wiper ring in place.

In FIG. 5 there is shown a portion of an annular washer 28, retangular in cross-section, utilized to give structural integrity to the container 2 and as a paint wipe with uniformly spaced holes 29 therethrough for paint run-off. Washer 28 fits between the two annular beads 11 and 12 and gives structural stability to the upper portion of the container as well as acting as a paint brush wipe to remove excess paint from the brush when painting. The washer may remain freely removable from the container or it may be welded in once the container has been removed from its mold during manufacture. The washer may take various shapes in cross-section other than that shown in FIG. 5 such as the right triangle 30 of FIG. 6 in which the upper side 31 is horizontal and lower side 32 slopes upwardly or the obtuse triangle of FIG. 7 in which both the upper side 35 and lower side 36 slope upwardly. Although holes 29, 33, and 37 have been shown in each of the washer embodiments, uniformly spaced holes for paint runoff are not necessary except perhaps for the embodiment of FIG. 7.

Figure 9:
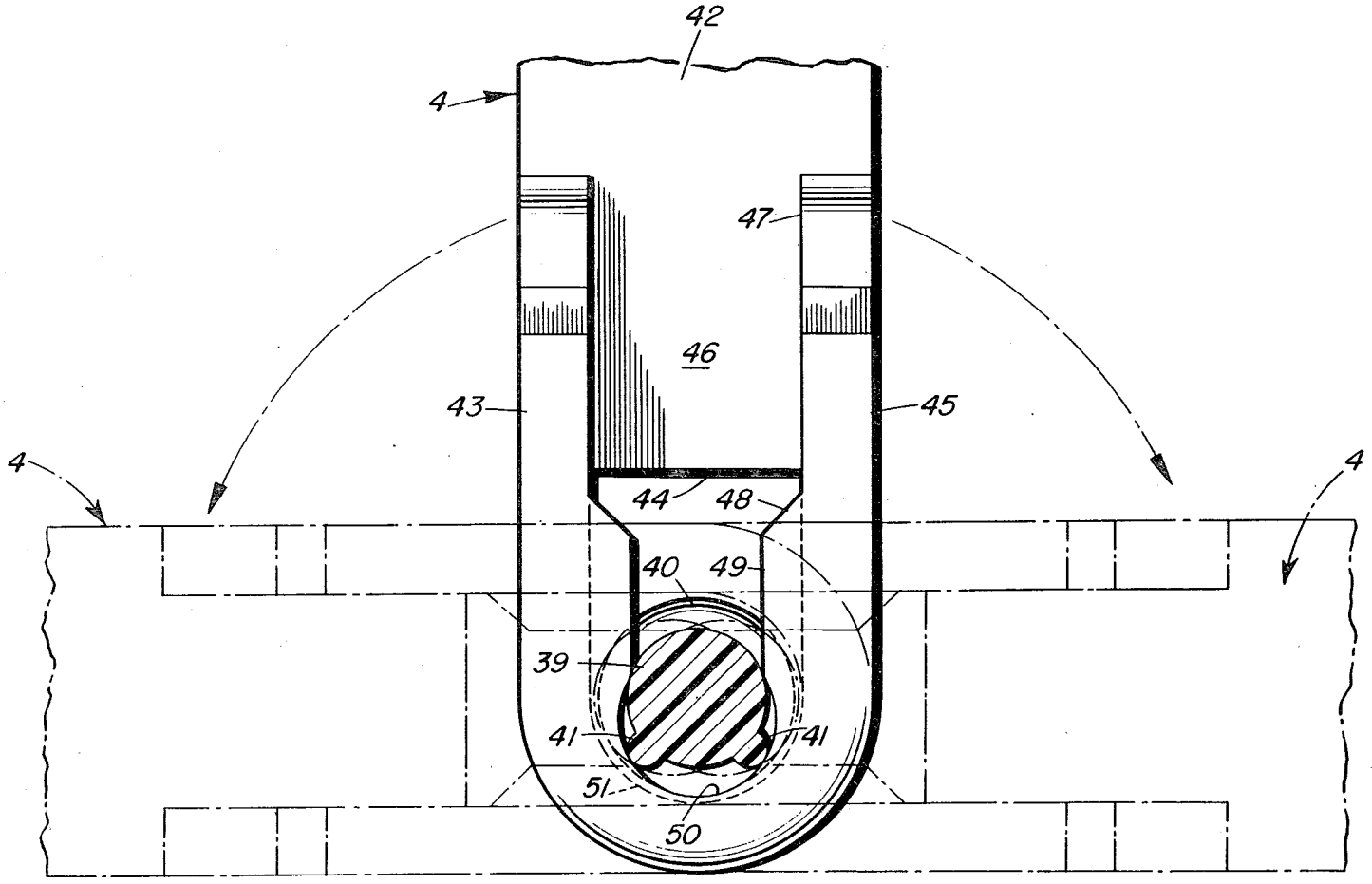
FIG. 9 is a sectional view of the handle assembly taken along line 9—9 of FIG. 8.

The handle assembly 4 is shown in greater detail in FIGS. 8 and 9. Extending from the wall 7 of the container 2 on diametrically opposed sides thereof and integral therewith are two stud bases 38 from each of which extends a cylindrical stud 39 and to which a cylindrical disk 40 is attached at the end of the stud 39. The stud base 38 extends downwardly from the skirt 14 and is integral therewith. Extending longitudinally on the lower portion of the stud 39 and spaced approximately 90° from each other are beads 41. Attachable to the stud 39 and disk 40 is a handle strap 42. Integral with the ends of the handle strap 42 are disk supports 43 of greater thickness than the strap 42. The handle strap 42 terminates at its end 44. The disk support 43 defines a configurated flange 45 positioned beyond the end 44 of handle strap 42 and which flange is offset transversely from said end 44 a distance of less than the thickness of the disk 40. The disk support 43 also defines a longitudinal slot 46 having a guide section 47 of greater width than the diameter of the disk 40, a tapered section 48 tapering to a section 49 of uniform width, which width is less than the diameter of the stud 39, and a terminating circular section 50 of diameter at least equal to the diameter of the stud but less than the diameter of the disk 40. An opening 51 transverse to the flange 45 through the disk support 43 extends from the end 44 of the handle strap 42 to the circular section 50.

In attaching the handle strap 42 to the container 2 the longitudinal slot 46 is slipped over the disk 40 and moved longitudinally until the section 49 of the slot 46 and flange 45 reach the disk 40 at which time the flange 45 is slipped interiorly of the disk 40. The longitudinal movement of the slot is then continued until the stud 39 seats in circular section 50 of the slot 46. As a result of the longitudinal beads 41 the stud 39 seating in the circular section 50 is forced into contact with the end of section 49 so that when the handle assembly 4 is placed in any position it will maintain that position. Due to the off setting of the end 44 of the handle strap 42 from the flange 45 the disk 40 is prevented from becoming separated from the handle strap unless the strap is outwardly angled with respect to the disk 40. Thus the assembled handle strap 42 can not be separated from the container 2 while it is being carried.

In FIG. 1 a rectangular shaped protuberance 52 extends from skirt 14 and a rectangular indentation 53 is cut in the lower side wall 7 of the container 2. Both the protuberance 52 and indentation 53 are indexing points used in the filling and capping of the container.

The container 2 carries a high gloss resulting from the material from which it is made as well as the manner in which it is made. The container is made of polypropylene or polyethylene and carries less than a 1° taper from top to bottom which enables it to be removed from the mold without being scratched by the mold. A preferable taper is 0.5°. The high gloss enhances the printing of information thereon.

It should be understood that minor changes in configuration and materials may be made without departing from the spirit of the invention and the scope of the appended claims. In particular, the material mentioned above for the container and closure may be replaced by other materials which have substantially the same characteristics.

What is claimed is:

1. A plastic fluid tight container and closure assembly comprising a plastic container having a base, a sidewall extending upwardly from the base terminating in a rim defining an opening for the container, said sidewall defining on its inside a sloping abutment surface extending inwardly and downwardly from said rim and an annular notch terminating said abutment surface, and a plastic closure having a circular cover portion, a U-shaped annular rim joined to the periphery of said cover portion, said U-shaped rim having an inner wall and a radially spaced outer wall connected by a base to said inner wall, the outside of said outer wall defining an annular shoulder positioned above the level of the base, an abutment surface extending upwardly and outwardly from the shoulder and an angular annular flange joined to the upper end of the outer wall to form an annular groove, said closure when assembled on said container having its shoulder locked to the notch of said container, its abutment surface in liquid sealing contact with the abutment surface of said container and its annular groove fitting over the rim of said container.

2. The assembly of claim 1 wherein the outside of the sidewall of said container defines an annular flange from which depends an annular skirt, and between said wall and skirt are positioned radially extending braces, the bottom of said skirt being above the level of said notch.

3. The assembly of claim 1 or claim 2 wherein the inside of the sidewall of the container defines two annular beads positioned below the notch and includes an annular washer positioned between said beads.

4. The assembly of claim 3 wherein a vertical cross-section of said washer is rectangular in shape.

5. The assembly of claim 3 wherein a vertical cross-section of said washer is right triangular in shape.

6. The assembly of claim 3 wherein a vertical cross-section of said washer is obtuse triangular in shape.

7. The assembly of claim 3 wherein said washer defines uniformly spaced holes therein.

8. The assembly of claim 1 wherein the sidewall of said container defines 0.5° of taper from the rim to the base.

9. The assembly of claim 1 wherein said sidewall of said container defines diametrically opposed stud bases from each of which radially extends a stud to which radial end thereof is integrally formed a cylindrical disk, said stud bases extending downwardly from said skirt and being integral therewith, said studs each defining two longitudinally extending beads on a lower portion thereof and including a handle strap at each end thereof attached to each said stud and disk.

10. The assembly of claim 9 wherein said handle strap has integral therewith at an end thereof a disk support of greater thickness than the strap, said disk support defining a configurated flange positioned beyond the end of said strap and offset transverely from said end a distance less than the thickness of said disk, a longitudinal slot having a guide section of greater width than the diameter of said disk, a tapered section tapering to a section of uniform width, which width is less than the diameter of the stud, and a terminating circular section of diameter at least equal to the diameter of said stud but less than the diameter of said disk and an opening through said disk support extending from the end of the handle strap to said circular section.

11. The assembly of claim 1 made from polypropylene.

12. The assembly of claim 3 made from polypropylene.

13. The assembly of claim 9 or claim 10 made from polypropylene.

14. The assembly of claim 1 made from polyethylene.

15. The assembly of claim 3 made from polyethylene.

16. The assembly of claim 9 or claim 10 made from polyethylene.

* * * * *